US012708819B1

(12) United States Patent
Hargrove et al.

(10) Patent No.: US 12,708,819 B1
(45) Date of Patent: Aug. 18, 2026

(54) BALL RETURN SYSTEM AND DEVICE

(71) Applicants: Johnny Hargrove, Council Bluffs, IA (US); Reza Gholi Mirghahari, Cordova, TN (US)

(72) Inventors: Johnny Hargrove, Council Bluffs, IA (US); Reza Gholi Mirghahari, Cordova, TN (US)

(73) Assignee: GLOBAL SOCCER LLC, Council Bluffs, IA (US)

( * ) Notice: Subject to any disclaimer, the term of this patent is extended or adjusted under 35 U.S.C. 154(b) by 99 days.

(21) Appl. No.: 18/792,092

(22) Filed: Aug. 1, 2024

Related U.S. Application Data

(60) Provisional application No. 63/518,297, filed on Aug. 8, 2023.

(51) Int. Cl.
*A63B 47/02* (2006.01)
*A63B 43/00* (2006.01)

(52) U.S. Cl.
CPC ..... *A63B 47/021* (2013.01); *A63B 43/00* (2013.01); *A63B 2047/022* (2013.01)

(58) Field of Classification Search
CPC .. A63B 47/021; A63B 43/00; A63B 2047/022
See application file for complete search history.

(56) References Cited

U.S. PATENT DOCUMENTS

2006/0063622 A1* 3/2006 Nurnberg ..... A63B 41/02 473/604
2009/0003136 A1* 1/2009 Karr ..... A63B 24/0021 367/128
2013/0210563 A1* 8/2013 Hollinger ..... A63B 37/0003 473/570
2017/0296880 A1* 10/2017 Paarpom ..... A63H 29/00

FOREIGN PATENT DOCUMENTS

FR 3010910 A1 * 3/2015 ..... A63B 43/00

OTHER PUBLICATIONS

Translation of FR 3010910 A1. (Year: 2015).*

* cited by examiner

*Primary Examiner* — Jeffrey S Vanderveen
(74) *Attorney, Agent, or Firm* — Schrantz Law Firm, PLLC; Stephen D. Schrantz

(57) ABSTRACT

The device and system for returning a ball drives the ball to a return location. The ball communicates with a return device that identifies the return location to which the ball will travel. The return device transmits a wireless signal to the ball identifying the return location. Actuators, such as motors, within the ball rotate drive wheels that drive the ball. The drive wheels contact an inner surface of the ball and direct the ball to the return location. A guidance system within the ball operates the wheels to drive the ball to the return location.

20 Claims, 9 Drawing Sheets

BALL RETURN SYSTEM AND DEVICE

CROSS-REFERENCE TO RELATED APPLICATIONS

This application is a continuation in part of U.S. Patent Application No. 63/518,297 filed on Aug. 8, 2023 entitled BALL RETURN SYSTEM AND DEVICE.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

Field of the Invention

The present invention relates to a ball and sports. More specifically, the present invention relates to a ball that returns to a defined location, such as a return location. A user exerts a force on the ball, such as throwing the ball, kicking the ball, punting the ball, hitting the ball, that causes the ball to travel away from the user. The user must then fetch the ball if the user wants to continue playing with the ball. The present invention includes an actuator that drives at least one wheel inside of the ball to return the ball to the return location.

Background of the Invention

The user may kick, throw, pass, shoot, or otherwise exert a force on a ball. The ball then travels away from the user. If the user is not playing with a partner, the user must then fetch the ball to continue playing. The user must spend time and effort fetching the ball instead of continuing to practice. The present invention increases playing time while decreasing downtime caused by fetching balls.

SUMMARY OF THE INVENTION

The device and system for returning a ball provides a ball with internal components that drive the ball to a defined location, such as a return location. The ball communicates with a return device that identifies the location to which the ball will travel. The return device transmits a signal. The ball returns to the signal. In one embodiment, the return device transmits a GPS location. The ball then returns to the GPS location.

Wheels within the ball rotate to drive the ball. In one embodiment, the wheels contact an inner surface of the ball and direct the ball to the return location. In another embodiment, the wheels do not contact the ball. Instead, the wheels rotate to drive the ball by angular momentum (reaction torque). A guidance system within the ball operates the wheels to drive the ball to the return location.

It is an object of the present invention to return a ball to a defined location, such as a return location.

It is an object of the present invention to improve practice time of the user.

It is an object of the present invention to increase efficiency of the user's practice time.

It is another object of the present invention to reduce the loss of the ball.

It is another object of the present invention to reduce time fetching the ball.

It is another object of the present invention to focus on practicing instead of fetching the ball.

It is another object of the present invention to reduce the energy and effort required to fetch the ball.

It is another object of the present invention to increase practice time while reducing time spent fetching the ball.

It is another object of the present invention to increase efficiency and effectiveness of practice.

Other objects, features, and advantages of the invention will be apparent from the following detailed description taken in connection with the accompanying drawings.

In addition to the features and advantages of the device and system for returning a ball according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

DETAILED DESCRIPTION OF THE INVENTION

Figure 1:
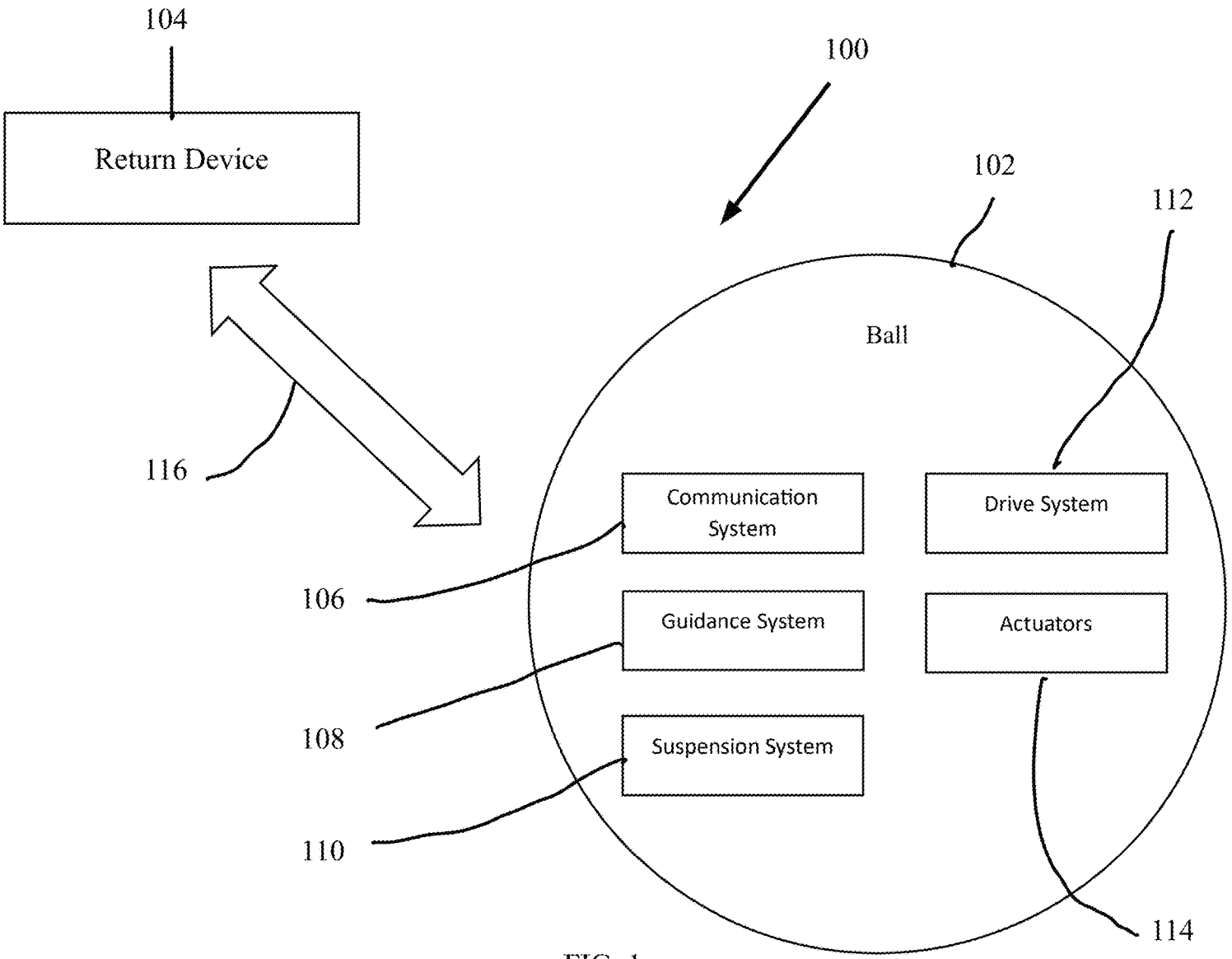
FIG. 1 is a schematic view of one embodiment of the ball return system.

FIG. 1 shows the system (generally shown as 100) with a ball 102 and return device 104. The return device 104 wirelessly communicates with the ball via a wireless transmission 116. The return device 104 instructs the ball 102 to travel to a location via wireless transmission 116. The ball of one embodiment is sporting equipment. Such a ball may be an inflatable ball that provides a valve for adjusting the air pressure of a bladder within the inflatable ball.

The ball also stores a power source, such as a battery, within the ball. The inflated ball provides a valve to inflate the ball. The ball of one embodiment provides a port, such as a charging port, to charge the battery within the ball. The port may be a USB port, a plug, or other charging port that connects to the battery for charging the battery. Another embodiment wirelessly charges the battery.

The return device 104 communicates the return location to the communication system 106 within the ball 102. In one embodiment, the user has the return device on his/her body. The ball 102 travels away from the user and the return device 104. The return device 104 instructs the ball 102 to return to a defined location, such as a return location. In one embodiment, the return location is the location of the return device carried on the user.

In one embodiment, the return device 104 transmits a GPS location to which the ball returns via wireless signal 116. In another embodiment, the return device 104 transmits a continuous wireless signal 116. The ball 102 follows the wireless signal 116 to the wireless device 104.

The device and system for returning a ball involves a ball with internal components that drive the ball to the return location. The ball 104 includes a communication system 106, such as a transceiver, transmitter, and/or a receiver, a guidance system 108, a suspension system 110 for the controls and processors, a drive system 112, and at least one actuator 114.

The communication system 106 communicates with the return device 104. FIG. 1 shows the ball 102 receiving communication from the return device 104. It may be one way communication or two way communication. The return device 104 communicates with the ball 102 to instruct the ball to return to the return location. The ball 102 may also communicate with the return device 104. The ball 102 may inform the return device 104 of the location of the ball 102. The location of the ball 102 allows the user to find the ball 102 if the ball 102 does not or cannot return to the return location. The wireless communication may include, but is not limited to, Bluetooth, WIFI, radio signals, or other wireless communication.

In one embodiment, the return device 104 functions as a beacon, such as a locator beacon/homing beacon. The user may activate the return device 104 to request that the ball return to the return device 104. The return device 104 transmits a signal, such as a radio signal, via the communication system (transceiver or transmitter).

The communication system of the ball receives the return signal. The communication system coordinating with the guidance system and the drive system direct the ball towards the return device. The guidance system directs the ball in the direction that the strength of the return signal increases. If the return signal decreases, the ball is moving away from the return device. The guidance system continues driving the ball towards the return device by guiding the ball in the direction that increases the return signal. Another embodiment may triangulate the location of the return device to specify the location of the return device.

The return signal may be a radio signal. The return device may include a radio transmitter that transmits the location of the return device and the return location. The return device and ball may communicate through radio signals or other wireless communication including, but not limited to, Bluetooth, near field communication, ultra wideband, radio signals, and other wireless systems.

The guidance system 108 communicates with the drive system 112 and actuator 114. The guidance system 108 provides the directions to direct the ball to the return location. The guidance system 108 identifies the location of the ball and the return location. The guidance system 108 instructs the operation of the actuators and the drive wheels to return to the return location.

The drive system 112 and actuator 114 instruct the operation of the drive wheels to drive the ball 102. The drive system 112 determines the directions required to travel to the return location via the guidance system 108. The drive system 112 operates the actuators 114 to drive the ball 102 to the return location. The drive system 112 instructs the actuators 114 to turn the different wheels at different speeds and directions or does not turn the drive wheels to direct the ball 102 in the proper direction. The actuators 114 drive the drive wheels for driving the ball 102.

The suspension system 110 supports the control system within the ball 102. The suspension system 110 creates contact of the drive wheels with the ball 102. The suspension system 110 maintains contact of the drive wheels with the ball 102. The suspension system also maintains the control system within the interior of the ball off of the sides of the ball 102.

Figure 2:
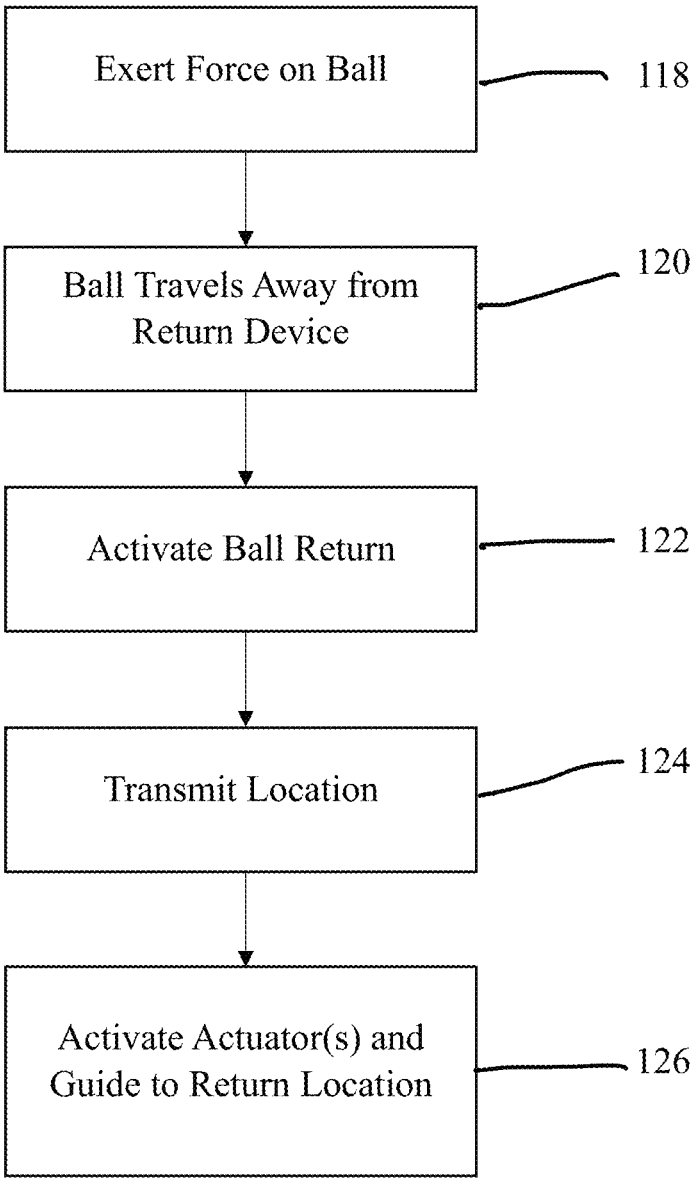
FIG. 2 shows a flow chart of one embodiment of the ball return method.

FIG. 2 shows the process of using the ball and returning the ball to the user. The user exerts a force on the ball at Exert Force on Ball Step 118. The user may kick, throw, hit, strike, or otherwise exert a force on the ball. The ball then travels away from the user and the return device at Ball Travels Away from Return Device Step 120.

To avoid fetching the ball, the user activates the ball return at Activate Ball Return 122. Activating the ball return communicates the return location to which the ball returns at Transmit Location Step 124. The return device identifies the return location to which the ball will travel. The return device transmits a wireless signal to the ball that identifies the return location. In one embodiment, the return device transmits a GPS location as the return location. In one embodiment, the return device transmits the GPS location of the return device as the return location. In another embodiment, the return device transmits a programmed GPS location as the return location. In another embodiment, the return device sends a signal that the ball follows. The return device sends a repeated signal indicating the return location to which the ball returns. The return device may send a continuous signal or an intermittent signal indicating the return location to which the ball will travel.

The ball then returns to the return location. The ball activates the actuators and guides the ball to the return location at Activate Actuator(s) and Guide to Return Location Step 126. The actuators rotate drive wheels that roll the ball in a specific direction. The control system activates the appropriate actuators at the appropriate speeds and direction to drive the ball to the return location. Some actuators may not activate when driving the ball.

Figure 6:
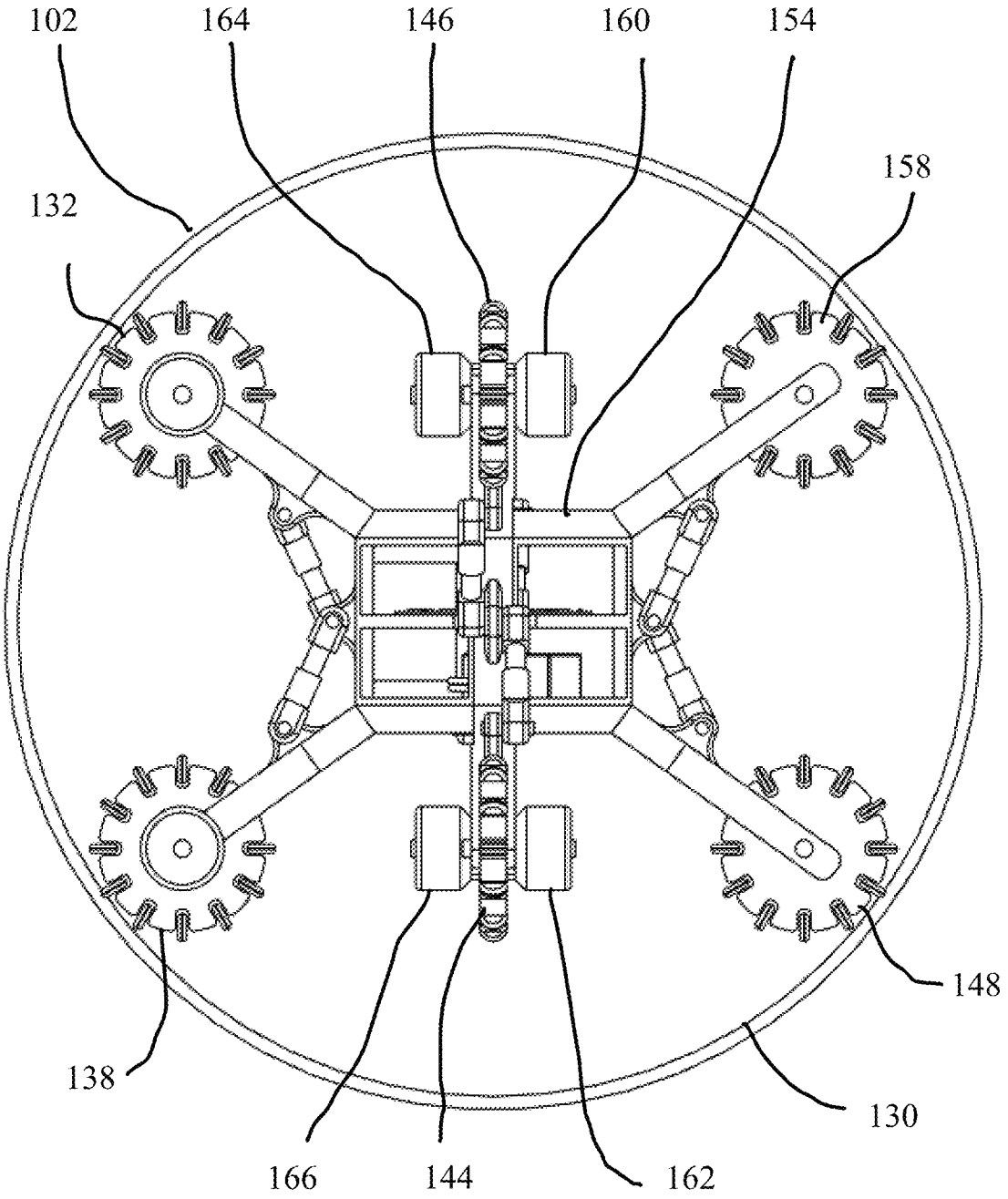
FIG. 6 is a partial view thereof.

FIGS. 3-6 show the internal components of the ball 102. The ball has an outer surface 128 and an inner surface 130. Eight drive wheels inside of ball 102 drive the ball to the return location through a frictional engagement with the inner surface 130 of ball 102. FIG. 6 shows a partial front view with a portion of the ball removed. The rear view is a mirror image of FIG. 6. Two additional drive wheels located behind drive wheels 144, 146 contact the inner surface 130 to drive the ball 102. The drive wheels 132, 138 144, 146, 148, 150, 158 (behind 146), and an additional drive wheel behind wheel 144 contact the inner surface 130 of ball 102 to drive the ball to the return location. Gripping surfaces 156 on each drive wheel contact the inner surface 130 when driving the ball 102.

Actuators 160, 162, 164, 166 rotate the drive wheels. At least one actuator is connected to each drive wheel to drive the drive wheel. Actuators 164, 166 drive the drive wheels located behind drive wheels 144, 146. Attachment arms 134, 140 secure each drive wheel to the housing 154. Each drive wheel is paired with a corresponding drive wheel. Each drive wheel is vertically offset from its corresponding drive wheel as shown in FIG. 6.

Figure 3:
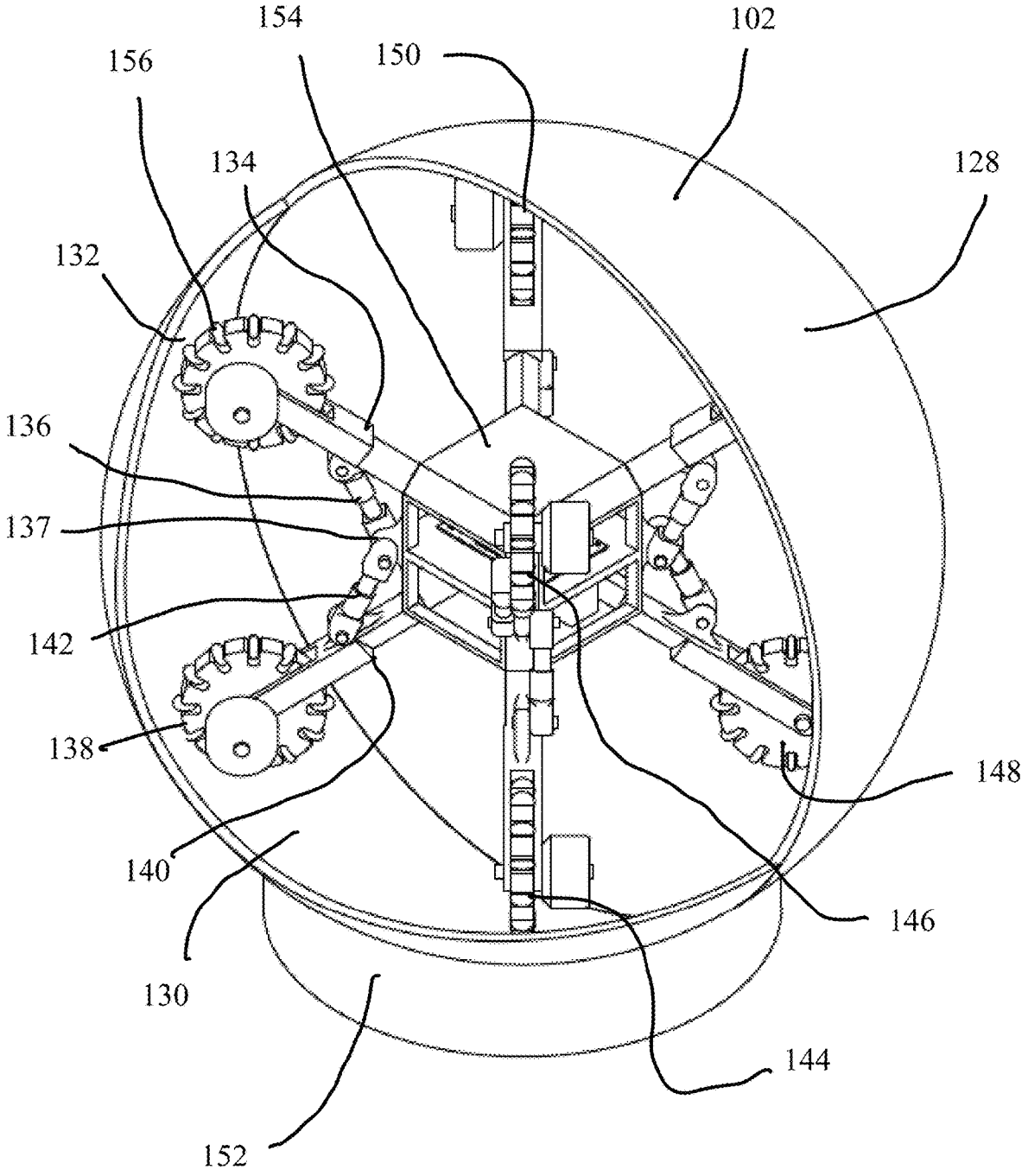
FIG. 3 is a partial view of one embodiment of the present invention.
Figure 4:
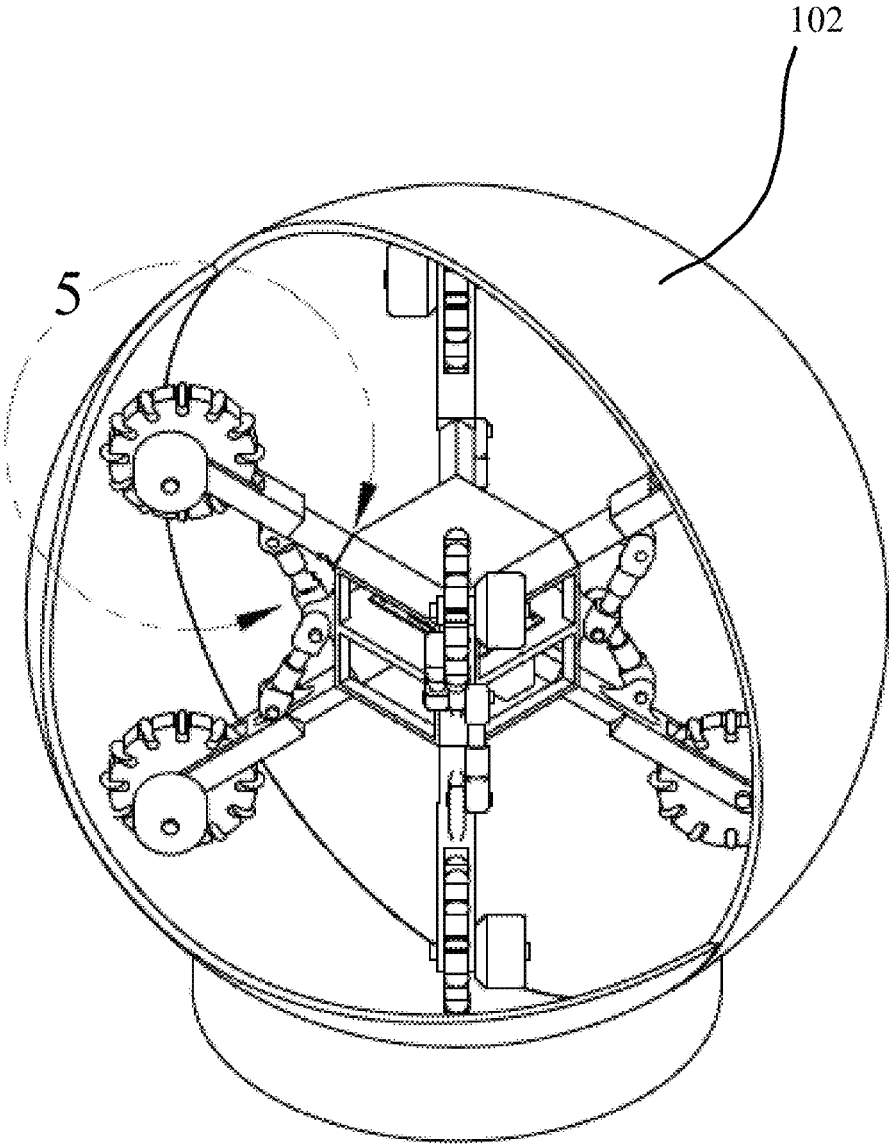
FIG. 4 is a partial view thereof.
Figure 5:
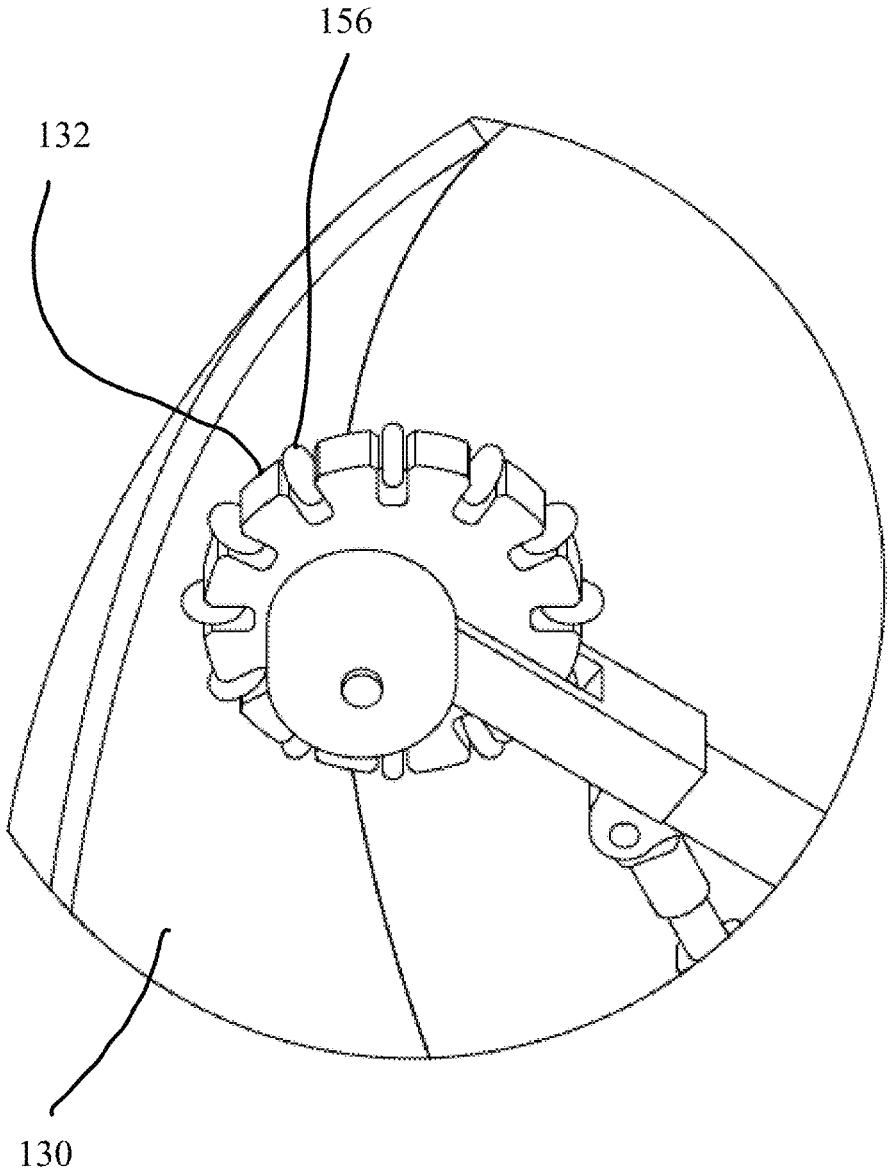
FIG. 5 is a partial view thereof.

Referring to FIGS. 3 and 6, the housing 154 orients the drive wheels 132, 138 144, 146, 148, 150, 158 along a first axis (such as a longitudinal axis) and a second axis (such as a lateral axis) with each pair of drive wheels vertically offset. Drive wheels 144, 146, 158 and the drive wheels located longitudinally rearward of drive wheels 144, 146 are oriented along the first axis (longitudinal axis) for driving the ball 102 longitudinally. Drive wheels 132, 138, 148, 158 are oriented along the second axis (lateral axis) for driving the ball 102 laterally.

Each pair of drive wheels are connected by a suspension. Suspensions 136, 142 pivotally attach to attachment arms 134, 140. Suspensions 136, 142 also pivotally attach to the housing 154 at housing attachment 137. The suspensions 136, 142 allow movement of the drive wheels secured to the suspensions 136, 142. Such movement may occur during exerting the force on the ball, such as kicking, throwing, hitting, the ball, or striking a surface. The ball may deform as the force is exerted on the ball. The suspensions 136, 142 allow movement of the appropriate drive wheel and returns the drive wheel to contact the inner surface 130 of the ball 102.

The housing 154 stores the drive system, the communication system, the power source, such as a battery, the control system, and the guidance system. The control system within the ball activates actuators to guide the ball to the return location. The guidance system operates and controls the wheels to drive the ball to the return location.

A power source, such as a battery, within the housing 154 powers the actuators, communication system, guidance system, drive systems, and other powered components. A charging station 152 charges the power source. In one embodiment, the charging station 152 wirelessly charges the power source. In another embodiment, the charging station may plug into the ball to charge the power source. In another embodiment, the ball, such as the inflatable ball, provides a charging port that accepts a charging input for charging the power source, such as the battery. The charging input connects to the battery to charge the battery.

Figure 7:
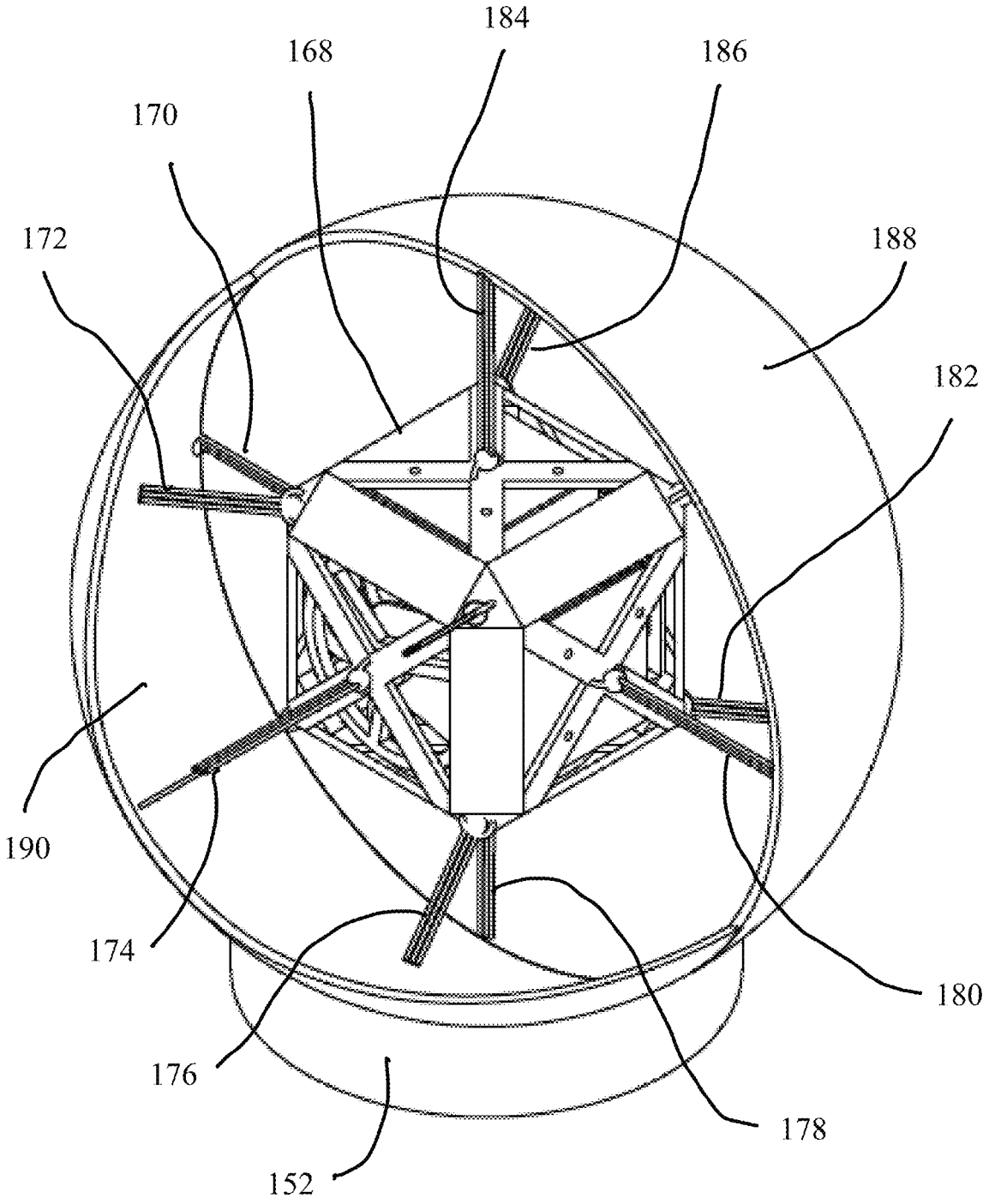
FIG. 7 is a partial view of one embodiment of the present invention.
Figure 8:
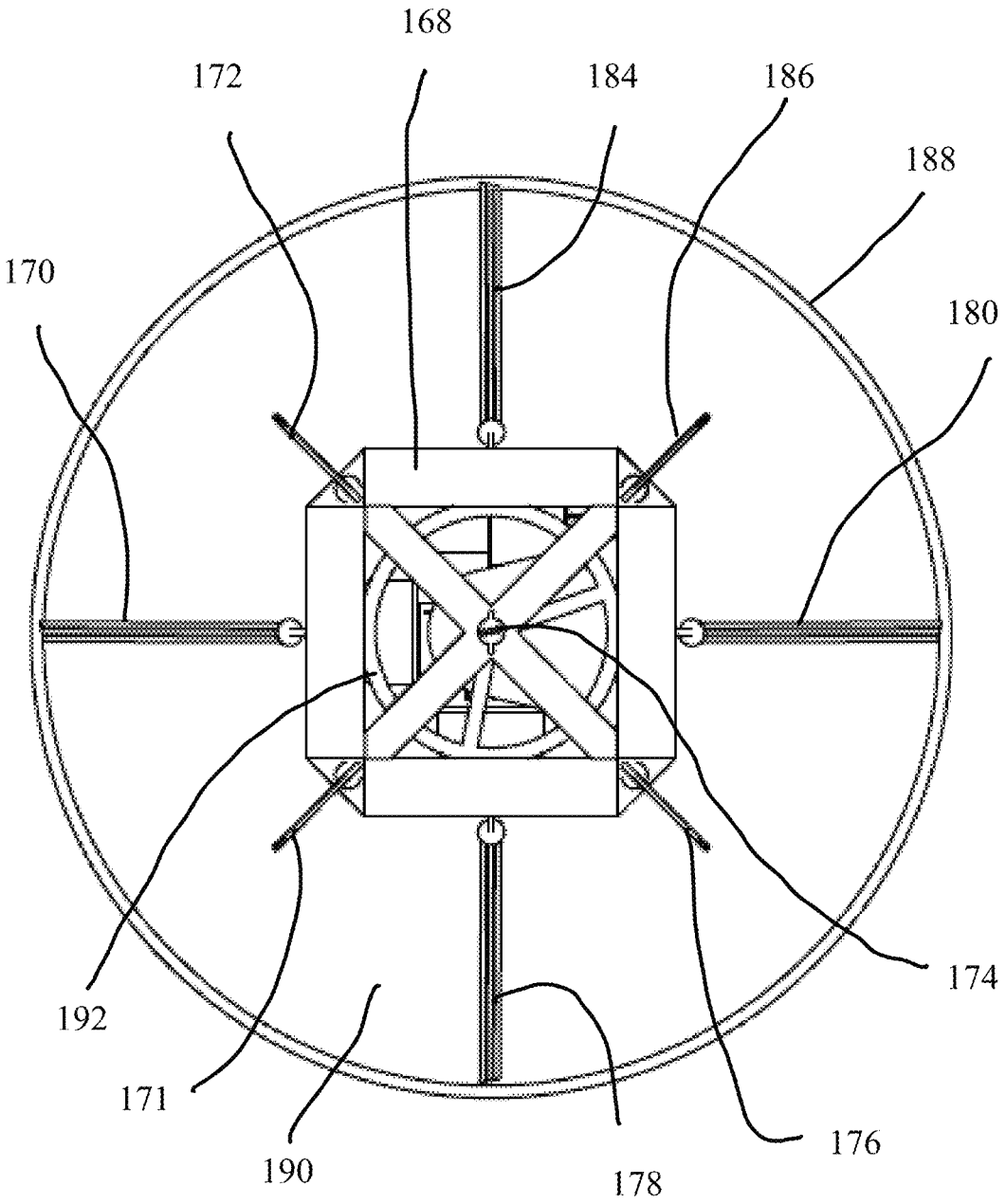
FIG. 8 is a partial view of thereof.
Figure 9:
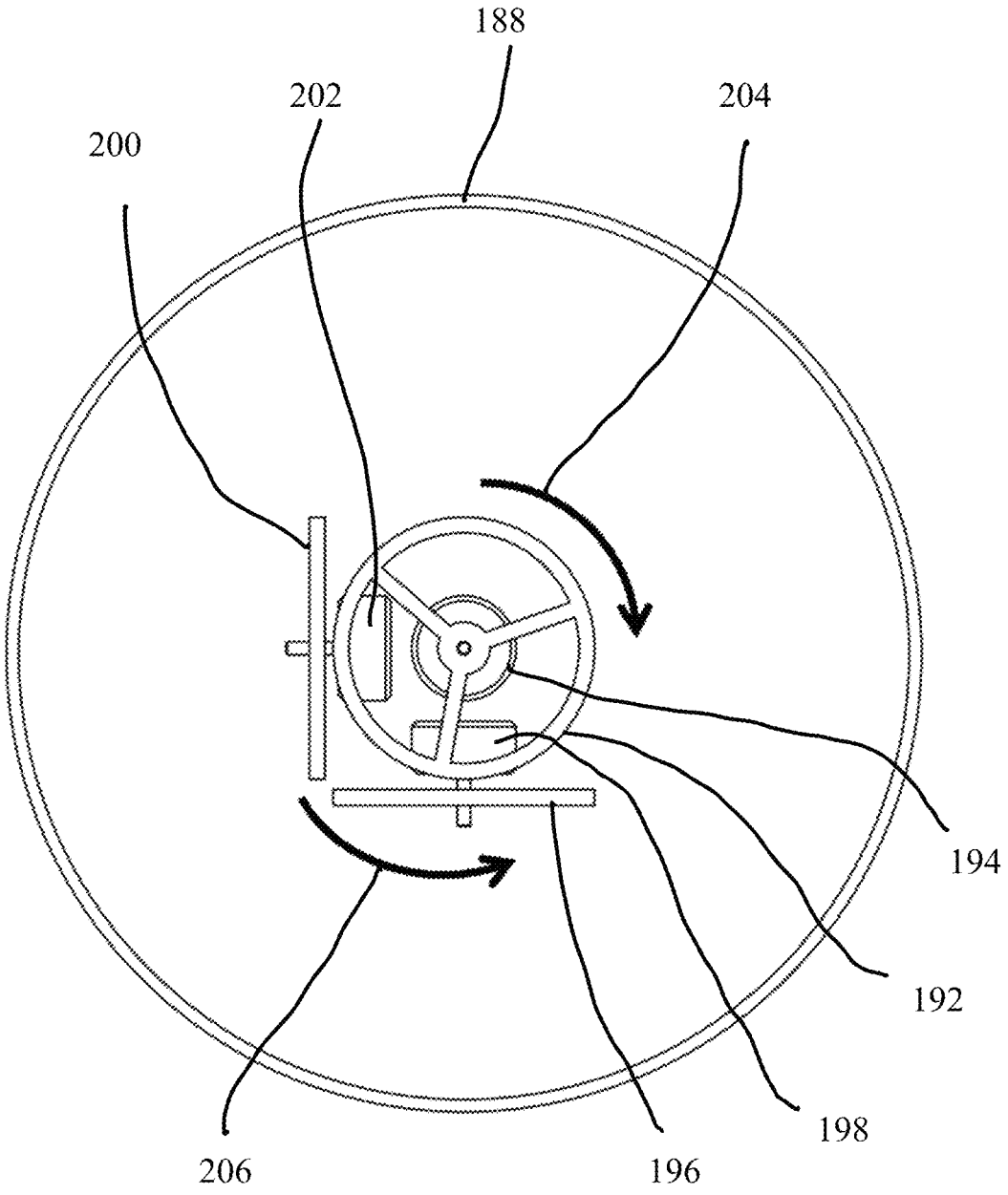
FIG. 9 is a partial view thereof.

FIGS. 7-9 show another embodiment of the present invention driven by reaction torque of a reaction cube, such as housing 168. The drive wheels 192, 196, 200 accelerate to create a reaction torque (conservation of angular momentum) on the ball 188. Accelerating and decelerating the drive wheels 192, 196, 200 in a first direction 204 applies a counter-torque in the opposite direction 206 of the wheels rotation in the first direction 204. The ball rolls due to the counter-torque in the opposite direction 206.

Three drive wheels 192, 196, 200 oriented along the three axes (the x-axis, the y-axis, and the z-axis) drive the ball. Each drive wheel 192, 196, 200 oriented along the different axes control the ball and movement of the ball. The drive wheels 192, 196, 200 control the ball 188 in three degrees of freedom (rotation in x, y, and z axis) to induce rolling and orientation.

Continuing to refer to FIGS. 7 and 8, suspensions support the housing 168 within the ball 188. In one embodiment, fourteen suspensions secure the housing 168 within the ball 188. FIG. 8 shows a front view with a portion of the ball removed. The rear view of the supports is a mirror image of the front view. Additional supports are located rearward of supports 174, 171, 172, 176, 186. The supports attach to the interior surface 190 of ball 188. Supports 170, 171, 172, 174, 176, 178, 180, 182, 184, 186 limit contact of the housing 168 with the interior surface 190. In one embodiment, supports are elastic attachments to the interior surface 190 of the ball 102.

The suspensions enable the housing 168 to shift slightly when the ball 188 experiences impact, without the housing 168 hitting the interior surface 190 of the ball. The suspensions are stiff enough to allow the force from the housing 168 to be transferred to the ball and induce motion control. In one embodiment, the housing 168 is a reaction cube. The suspensions, such as bands, attach the exterior surface of the housing to the interior surface of the ball.

FIG. 9 shows the drive wheels 192, 196, 200 such as flywheels that function as reaction wheels. Each drive wheel 192, 196, 200 attaches to an actuator 194, 198, 202. The actuators 194, 198, 202 are electric motors powered by a power source, such as a battery, within the housing 168. Placing the ball on charger 152 charges the power source within the housing 168.

Housing 168 stores the control system, communication system, guidance system, and drive system. In one embodiment, a computing device, such as a processor, instructs operation of the drive wheels. The communication system may be a transceiver, transmitter, or a receiver to communicate with the return device.

The present invention has been described with two different types of drive wheels. A drive wheel that directly contacts the interior surface of the ball. Applying torque to the drive wheels rolls the ball on the outside of the drive wheels. The drive wheels are omnidirectional for driving in different directions. Another embodiment of the drive wheels does not contact the interior surface of the ball. Instead, the drive wheels rotate to cause reaction torque to drive the ball.

The ball is shown as a round ball. Such round balls including, but not limited to, soccer balls, basketballs, tennis balls, volley balls, and baseballs, may be driven by the driving wheels. Other shaped balls, including but not limited to footballs and rugby balls, may be driven by the drive wheels.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A system for returning a ball to a return location, the system comprising:

a first drive wheel positioned within the ball, wherein the first drive wheel rotates in a first direction;

a second drive wheel positioned within the ball, wherein the second drive wheel rotates in a second direction, wherein the first direction is perpendicular to the second direction;

a drive system that drives the first drive wheel to rotate in the first direction and drives the second drive wheel in the second direction;

a first motor of the drive system, wherein the first motor drives the first drive wheel.

2. The system of claim 1 further comprising:

a guidance system that instructs operation of the first drive wheel and the second drive wheel, wherein the guidance system instructs the drive system to drive the first drive wheel and the second drive wheel.

3. The system of claim 1, wherein the first drive wheel and the second drive wheel drive the ball through reaction torque without contacting an interior of the ball.

4. The system of claim 1 further comprising:

a return device that communicates with a guidance system, wherein the return device instructs the guidance system of the return location.

5. The system of claim 4, wherein the return device transmits a GPS location to the guidance system.

6. The system of claim 5, wherein the GPS location is a location at which the return device is currently located.

7. The system of claim 4, wherein the return device transmits a return signal to the guidance system, wherein the guidance system directs the ball toward the return signal from the return device.

8. The system of claim 1, wherein the first drive wheel and the second drive wheel contact an interior of the ball to drive the ball.

9. The system of claim 1 further comprising:

a housing located within the ball, wherein the first drive wheel and the second drive wheel are connected to the housing;

a first pair of drive wheels that rotate in the first direction, wherein the first drive wheel is a drive wheel of the first pair of drive wheels;

a second pair of drive wheels that rotate in the first direction, wherein the first pair of drive wheels that rotate in the first direction axially align with the second pair of drive wheels that rotate in the first direction;

a first pair of drive wheels that rotate in the second direction, wherein the second drive wheel is a drive wheel of the second pair of drive wheels;

a second pair of drive wheels that rotate in the second direction, wherein the first pair of drive wheels that rotate in the second direction axially align with the second pair of drive wheels that rotate in the second direction.

10. The system of claim 9 further comprising:

an attachment point located on the housing between the first pair of drive wheels that rotate in the first direction, wherein the first pair of drive wheels that rotate in the first direction attach to the attachment point;

wherein suspensions secure the first pair of drive wheels that rotate in the first direction to the attachment point.

11. A system for returning a ball to a return location, the system comprising:

a first drive wheel positioned within the ball, wherein the first drive wheel rotates along a first axis;

a second drive wheel positioned within the ball, wherein the second drive wheel rotates along a second axis, wherein the first axis is perpendicular to the second axis;

a drive system that drives the first drive wheel to rotate along the first axis and drives the second drive wheel to rotate along the second axis;

a return device that communicates with a guidance system, wherein the return device instructs the guidance system of the return location.

12. The system of claim 11, wherein the return device transmits a GPS location to the guidance system.

13. The system of claim 12, wherein the GPS location is a location at which the return device is currently located.

14. The system of claim 11, wherein the return device transmits a return signal to the guidance system, wherein the guidance system directs the ball toward the return signal from the return device.

15. The system of claim 11, wherein the first drive wheel and the second drive wheel contact an interior of the ball to drive the ball.

16. The system of claim 11 further comprising:

a third drive wheel positioned within the ball, wherein the third drive wheel rotates along a third axis;

wherein the first axis is an x-axis;

wherein the second axis is a y-axis;

wherein the third axis is a z-axis;

wherein the first drive wheel, the second drive wheel, and the third drive wheel drive the ball through reaction torque without contacting an interior of the ball.

17. A system for returning a ball to a return location, the system comprising:

a first drive wheel positioned within the ball, wherein the first drive wheel rotates along a first axis;

a second drive wheel positioned within the ball, wherein the second drive wheel rotates along a second axis, wherein the first axis is perpendicular to the second axis;

a drive system that drives the first drive wheel to rotate along the first axis and drives the second drive wheel to rotate along the second axis;

a return device that communicates with a guidance system, wherein the return device instructs the guidance system of the return location to which the drive system drives the ball; and a housing positioned centrally within the ball, wherein the first drive wheel and the second drive wheel are connected to the housing.

18. The system of claim 17 further comprising:

a first pair of drive wheels that rotate in the first direction, wherein the first drive wheel is a drive wheel of the first pair of drive wheels;

a second pair of drive wheels that rotate in the first direction, wherein the first pair of drive wheels that rotate in the first direction axially align with the second pair of drive wheels that rotate in the first direction;

a first pair of drive wheels that rotate in the second direction, wherein the second drive wheel is a drive wheel of the second pair of drive wheels;

a second pair of drive wheels that rotate in the second direction, wherein the first pair of drive wheels that rotate in the second direction axially align with the second pair of drive wheels that rotate in the second direction wherein the first pair and the second pair of drive wheels that rotate in the first direction and the first pair and the second pair of drive wheels that rotate in the second direction position the housing centrally in the ball.

19. The system of claim 17 further comprising:

further comprising:

a third drive wheel positioned within the ball, wherein the third drive wheel rotates along a third axis;

wherein the first axis is an x-axis;

wherein the second axis is a y-axis;

wherein the third axis is a z-axis;

wherein the first drive wheel, the second drive wheel, and the third drive wheel drive the ball through reaction torque without contacting an interior of the ball.

20. The system of claim 19 further comprising:

a first elastic support and a second elastic support securing the housing to an interior of the ball, wherein the first elastic support and the second elastic support suspend the housing within the ball.

* * * * *